United States Patent [19]

De Brossard

[11] Patent Number: 4,504,985

[45] Date of Patent: Mar. 19, 1985

[54] SWIMMING POOL COPING

[75] Inventor: Philippe De Brossard, Menton, France

[73] Assignee: Societe Civile Professionnelle Gazzano & Blais, Menton, France; a part interest

[21] Appl. No.: 449,685

[22] Filed: Dec. 14, 1982

[51] Int. Cl.[3] ..... E04H 3/16; E04H 3/18

[52] U.S. Cl. ..... 4/506; 4/507; 4/508; 4/510; 4/512; 52/102; 52/169.7; 52/716

[58] Field of Search ..... 4/488, 506, 507, 510, 4/512, 508, 490; 52/169.7, 716, 300, 102

[56] References Cited

U.S. PATENT DOCUMENTS 3,824,634 7/1974 Lindquist ..... 4/506

*Primary Examiner*—Henry K. Artis

*Attorney, Agent, or Firm*—Young & Thompson

[57] ABSTRACT

A swimming pool coping permitting overflow, which is rectilinear and has an upwardly opening overflow channel therein parallel to its length. The coping has an upper surface that is flat and imperforate and is inclined upwardly from the channel at a small angle to the horizontal in a direction away from the water's edge, and a plurality of passageways through the coping that are inclined downwardly from the overflow channel in a direction away from the water's edge. The overflow channel is disposed more closely adjacent the water side of the coping than adjacent the side of the coping remote from the water and is defined between two upright side walls, the passageways opening through that one of the side walls which is farther from the water. The coping on the water side of the channel is at the same horizontal level as the coping immediately on the other side of the channel.

4 Claims, 2 Drawing Figures

SWIMMING POOL COPING

The present invention relates to swimming pool coping, permitting overflow, with a straight water's edge and lending the impression of a perfectly framed mirror.

Swimming pools are increasingly of the overflowing type, which means that the users no longer have the impression of being prisoners in a cave from which they can see only the ceiling, because the water level is at least two feet below the deck level, as is the case with present swimming pools.

Overflowing swimming pools permit users to be on the same level as the deck and they can therefore enjoy the landscaping and the view and follow events outside the pool.

The overflowing swimming pool coping of the present invention comprises a curb whose inclined plane permits the water, at the moment of overflow, to be caught in a gutter which returns the water to the pool circuit. This inclined plane of the curb permits obtaining a sinuous water line, always moving because of the waves and ripples on the surface of the pool water. This inclination of the curb provides a border which serves the purpose of a breakwater, the height of a wave being proportional to the height from the bottom.

These overflowing pools, in addition to the practical advantages for the users, have substantial aesthetic appeal. Because the water level comes up to the deck level, the mirror effect is remarkable. In present overflowing pools, the water's edge is not rectilinear.

The pool coping, according to the invention, permits obtaining a water's edge which is perfectly straight.

To this end, the coping is constituted at the level of the curb at the side of the water's edge by an overflow channel parallel to said edge, which ensures a rectilinear appearance for the water's edge. For larger waves the curb is extended with a slight incline to serve as a breakwater, and its highest point overlies a recovery channel for the water. Passageways with a gentle incline connect the first overflow channel to the water recovery channel.

The first channel imparts its rectilinear aspect to the water's edge for all the ripples and forms a complete frame for the surface of the water which comprises a mirror.

The curb is disposed on the main wall of the pool enclosure. On the water side, the curb projects slightly beyond said wall. The first channel is located at the level of the inner face of the wall. On the outer side of the pool, the curb overlies the recovery channel. According to the size of the pool, and therefore of the recovery channel, there can be provided a simple slot between the outer edge of the curb and the deck, across which the recovery channel is covered by a suitable grill. This is particularly the case for public pools.

The accompanying drawings are given by way of non-limiting example and permit easy comprehension of the invention. They show preferred embodiments of the invention.

Figure 1:
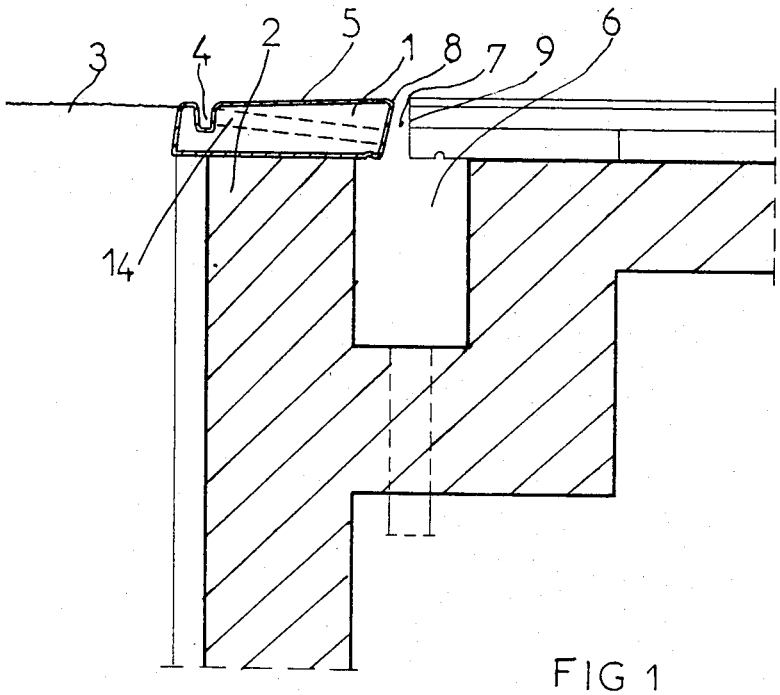
FIG. 1 is a cross-sectional view of a swimming pool and of its curb, in accordance with the invention.

Referring now to the drawings in greater detail, the coping 1 is disposed atop the enclosing wall 2 of the pool. On one side of the water level 3 of the pool, coping 1 overlies and overhangs the enclosure wall 2, and comprises a first overflow channel 4 parallel to the water's edge. The coping 1 is prolonged by a margin which serves as a wave break, of slight incline 5 downward toward the water level, which extends above a recovery channel 6.

In the case of a small pool, the recovery channel 6 is of medium size, and there may be simply a slot 7 between the summit 8 of coping 1 and the level of deck 9, as is shown in FIG. 1.

Figure 2:
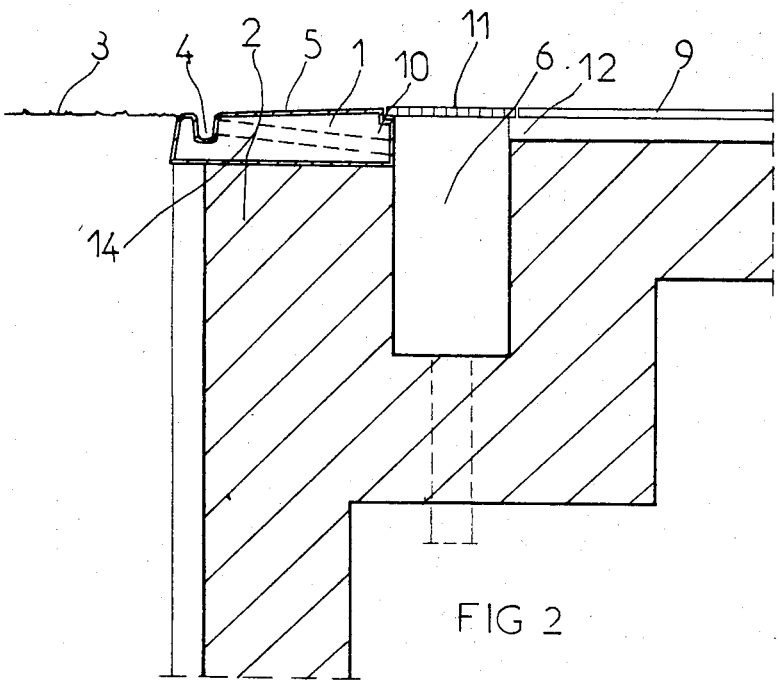
FIG. 2 is a cross-sectional view of a swimming pool whose recovery channel is covered by a grill, in accordance with the invention.

In the case of a larger pool, as shown in FIG. 2, the recovery channel 6 is covered by a grill 11 which rests on a shoulder 10 of coping 1 and a shoulder 12 of deck 9.

In both embodiments, the overflow channel 4 is connected to the recovery channel 6 by passageways 14 disposed at a slight incline downward toward recovery channel 6, these passageways 14 extending through the coping 1.

What is claimed is:

1. Swimning pool coping permitting overflow, the coping being rectilinear and having an upwardly opening overflow channel therein parallel to its length, the coping having an uppermost surface that is flat and imperforate and is inclined upwardly from said channel at a small angle to the horizontal in a direction away from the water's edge, and a plurality of passageways through the coping that are inclined downwardly from the overflow channel in a direction away from the water's edge and that are adapted to empty into a water recovery channel for a swimming pool , said overflow channel being disposed more closely adjacent the water side of the coping than adjacent the side of the coping remote from the water, said channel being defined between two upright side walls, said passageways opening through that one of said side walls which is farther from the water, the uppermost surface of the coping on the water side of the channel being at the same horizontal level as said uppermost surface of the coping immediately on the other side of the channel.

2. Swimming pool coping according to claim 1, in combination with a water recovery channel for a swimming pool, the water recovery channel underlying the upper edge of the upwardly sloping upper surface of the coping and underlying the lower ends of the downwardly sloping passageways.

3. Swimming pool coping according to claim 2, in combination with a deck surrounding the swimming pool and disposed at about the level of the upper edge of the upper surface of the coping, there being a gap between the coping and the deck beneath which is disposed in said water recovery channel.

4. Swimming pool coping as claimed in claim 3, and a grill closing said gap at the level of the upper surface of said deck.

* * * * *